United States Patent [19]

Mims

[11] 3,952,635

[45] Apr. 27, 1976

[54] VERTICAL CARTON ERECTOR

[75] Inventor: Herman Dewitt Mims, Charlotte, N.C.

[73] Assignee: D and B Machine Company, Charlotte, N.C.

[22] Filed: Sept. 20, 1974

[21] Appl. No.: 507,919

Related U.S. Application Data

[63] Continuation-in-part of Ser. No. 347,494, April 3, 1973, Pat. No. 3,859,896.

[52] U.S. Cl. ..... 93/51 R; 214/8.5 A; 271/30 A; 271/149

[51] Int. Cl.[2] ..... B31B 1/06

[58] Field of Search ..... 271/30 A, 149, 160, 271/126, 129; 214/8.5 A, 8.5 D; 93/53 SD, 53 R, 53 AC, 51 R

[56] References Cited

UNITED STATES PATENTS

| | | | |
|---|---|---|---|
| 3,127,027 | 3/1964 | Roser et al. | 214/8.5 A X |
| 3,376,796 | 4/1968 | Gordon | 93/51 R |
| 3,429,236 | 2/1969 | Randles, Jr. | 93/53 SD X |
| 3,434,711 | 3/1969 | Betschart | 271/149 |
| 3,539,179 | 11/1970 | Bergman et al. | 271/126 X |
| 3,709,114 | 1/1973 | Johnson et al. | 93/51 R |
| 3,739,696 | 6/1973 | Pearson | 93/53 R |
| 3,859,896 | 1/1975 | Mims | 93/51 R |

*Primary Examiner*—James F. Coan
*Attorney, Agent, or Firm*—Sughrue, Rothwell, Mion, Zinn & Macpeak

[57] ABSTRACT

Vertical carton erecting machine of the stationary diereciprocable plunger type, including an improved carton supply hopper. Feed arms are carried adjacent to the die to move to a blank hopper and directly pull a flat carton blank, presented by the hopper in proper registration for placement on the die, onto the top of the die in carton erecting position.

5 Claims, 9 Drawing Figures

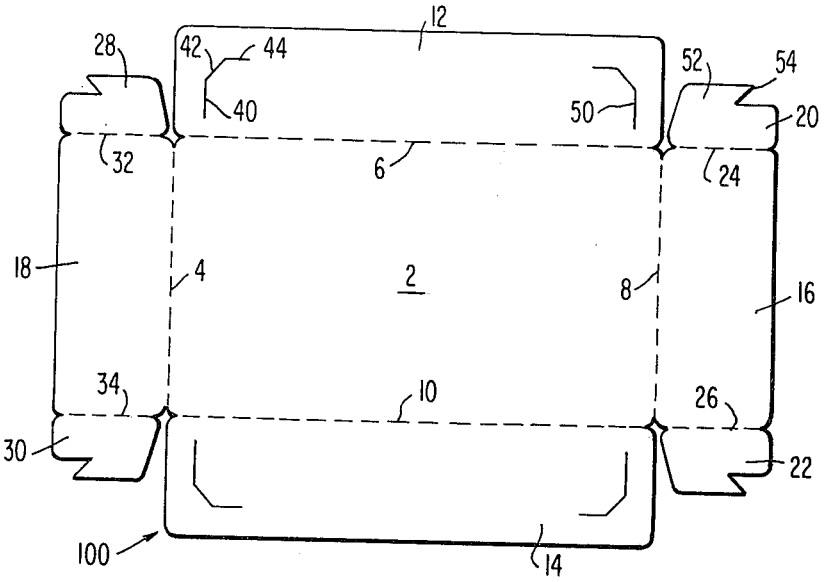
FIG. 1
FIG. 2
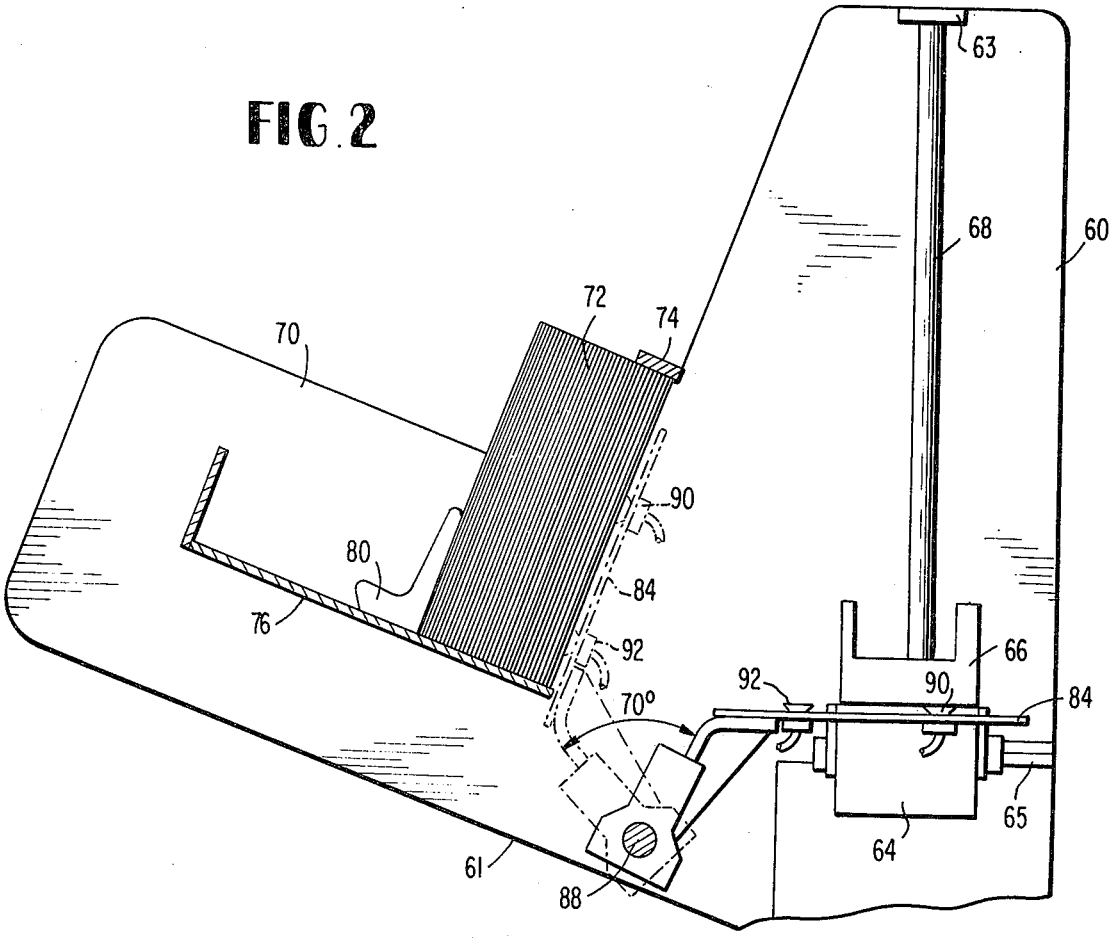

FIG.7
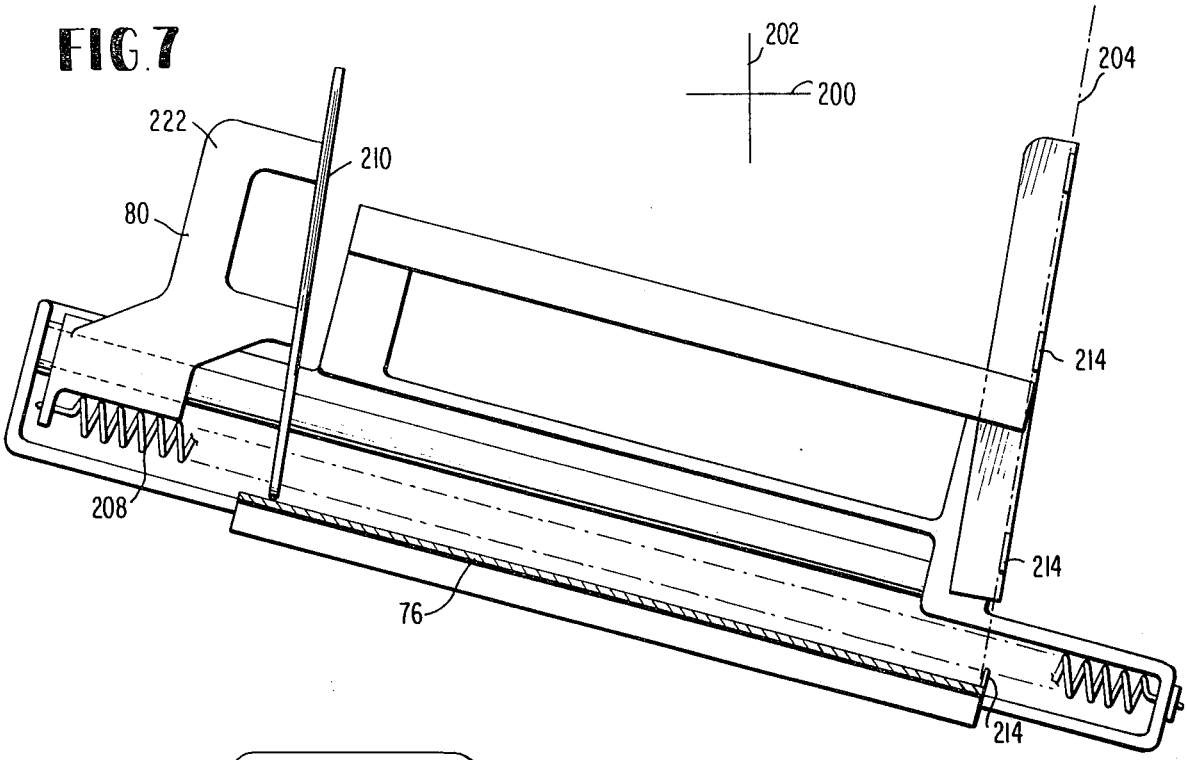
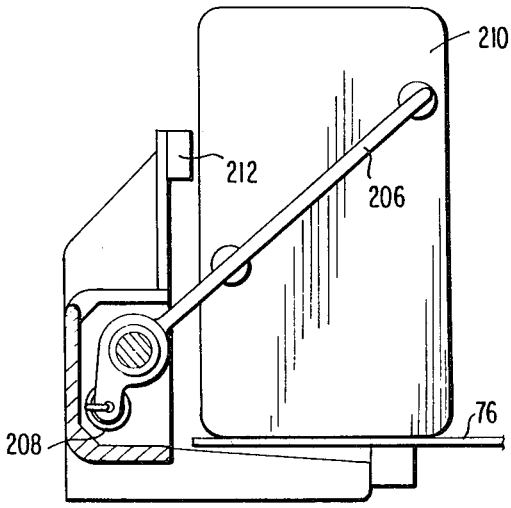
FIG.8
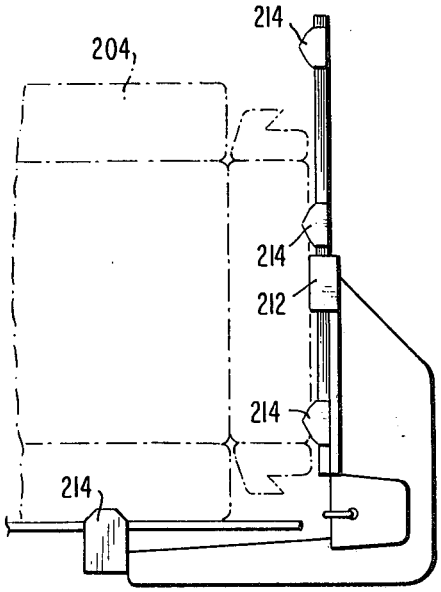
FIG.9

VERTICAL CARTON ERECTOR

CROSS REFERENCE TO RELATED APPLICATION

This application is a continuation-in-part application of Ser. No. 347,494, filed April 3, 1973, now U.S. Pat. No. 3,859,896, and particularly relates to an improvement in carton blank reservoir and supply means.

BACKGROUND OF THE INVENTION

Devices are known in the prior art to fold and interlock foldable sections of a flat carton blank to form an erected carton suitable as a container for numerous materials. One broad class of carton erecting machines are of the vertical die and plunger type. In general, a reciprocable plunger moving through an "up and down" cycle in a vertical plane forces a flat carton blank through a forming die open at both top and bottom. The sides of the die, whether stationary or movable in whole or in part, fold the side and end panels of the blank around the moving plunger as the plunger passes downwardly through the die, thereby erecting the side and end panels in relationship to the bottom of the box.

Today, where usable for the ultimate containing function, a glueless, interlocking carton will be preferred. Foldable corner lock flaps, each having a tab insertable into a cooperating slit located in an adjacent erected panel, are folded by the cooperating die and plunger, with the last erecting function of the apparatus usually being the locking of the "tab" into its cooperating slit. This is usually accomplished by movable parts on the die and/or plunger which push or pull the tab through the insertion slot. With erection complete, the carton is stripped off the plunger as it changes direction and passes upwardly, back through the die. The carton will then be forwarded to the next step in an integrated packaging operation.

In order to be able to erect carton blanks rapidly and repeatedly in an accurate fashion, an auxiliary carton blank reservoir means is provided to cooperate with a carton blank feeder. The reservoir, or hopper, and feeder apparatus must precisely place each carton blank, one at a time, onto the top of the die. Blank alignment, if not accomplished within narrow limits, will result in imperfect erection; that is, side and/or end panels will not be folded along the preset fold lines and/or locking tabs will not be positioned correctly to slip through the cooperating slits.

To enable the feeding mechanism to directly pull the carton blank onto the top of the die in proper registration for carton erection, the blank reservoir or hopper means must be able to sequentially present carton blanks in proper position for placement on the die without the need for additional blank registration.

Therefore, it is an object of this invention to provide an improved vertical carton erector.

More particularly it is an object of this invention to provide a vertical carton erector including an improved reservoir or hopper.

It is still another object of this invention to provide a vertical carton erector of the die and plunger type capable of rapid and reproducible erections of cartons of the glueless, corner interlocking type.

Another object of the invention is to accomplish the above using the most direct feeding procedure possible, said feeding procedure and accompanying apparatus including supply hopper allowing unusual precision alignment of the carton blank on the forming die without the aid of guide or carton positioning pins on the upper surface of the die.

Other objects of the invention, such as insuring constant pressure advancement of the carton blanks, insuring sequential presentment of carton blanks from the supply hopper at a substantially constant uniform low pressure and to provide these objectives in a supply hopper characterized by a minimum of moving parts, will be apparent to those skilled in the art upon reading the detailed description of the invention hereinbelow in relationship to the drawing.

SUMMARY OF THE INVENTION

The present invention relates to a vertical carton erector including stationary forming die and reciprocable plunger and an improved supply hopper, said erector comprising at least one carton blank feed arm positionable at a first at-rest station adjacent to and in the same or lower plane as that of the top or carton positioning surface of the die and at a second blank supply hopper station, said arm advancing from said first station to said second station where it engages a carton blank and then carries the blank as it returns to said first station to deposit the blank in correct alignment along the carton positioning surface of the die. After the carton has been erected and the plunger has passed upwardly back through the die, the at least one feed arm deposits the next carton blank. In this manner, the feed arm moves from a position adjacent to the top of the die, engages the underside or bottom (portion of the blank which will become the outside of the bottom of the carton after erection) of the blank and pulls it downwardly until the blank is placed on the die. This invention is particularly directed to a supply hopper used with the above erector. The supply hopper sequentially presents carton blanks properly registered for direct transfer to the top of the die.

In preferred embodiments of the invention with respect to the erector in general, there are at least two feed arms each pivotally attached by one end thereof at aligned pivot points on the machine frame, said arms carrying carton blank engaging means on their upper surfaces and rotating in synchronization through an arc of a circle upwardly from a first at-rest position to grip the underside of a carton blank at a blank reservoir by means of the blank engaging means (such as one or more suction cups), then reversing direction and rotating in synchronization back to said first position which is predetermined in cooperating with the positionment of the blank at the reservoir to leave the blank in desired alignment for erection on the die upon deactivation of the blank engagement means.

In other preferred embodiments of the invention with respect to the erector in general, the cooperating die and plunger are adapted to erect a carton of the insertable tab-slot locking type and to that end the die includes stationary carton side panel abutment guides which pressure open said slots, while the plunger includes inwardly reciprocating knife edges positioned to engage the outside of end panel tabs and push said tabs through their associated slots into locking configuration when moved inwardly by means of an automatic camming action caused by passage of the male plunger forming head through the female die.

Turning to the supply hopper, there is provided a carton support with a low friction surface inclined to the horizontal so that a nearly resistance-free surface is provided for carton advancement, and a carton stack pushing means adapted to provide a constantly changing force to the carton stack related to the load imposed by the stack so that each carton is presented under substantially the same load to the die feeding mechanism, i.e. the feed arms. The present invention relates to a carton erector of the type above-described in combination with such a feed hopper.

DESCRIPTION OF THE DRAWING

FIG. 1 of the drawing is a plan view of an interlocking carton erectable by means of the vertical carton erector depicted in the remaining figures of the drawing.

FIG. 2 of the drawing is a side view of the carton erector and associated carton blank feeding mechanism.

FIG. 7 of the drawing depicts in detail a side view of the carton feed hopper usable with the erector of FIG. 2.

FIG. 8 of the drawing shows the supply hopper of FIG. 7 of the drawing from the back of the carton feed hopper.

FIG. 9 of the drawing is a front view of the carton supply hopper of FIG. 7 of the drawing.

In the drawing, the same element numbers represent like parts in each of the figures in which they are used.

DETAILED DESCRIPTION OF THE INVENTION IN RELATIONSHIP TO THE DRAWING

Figure 3:
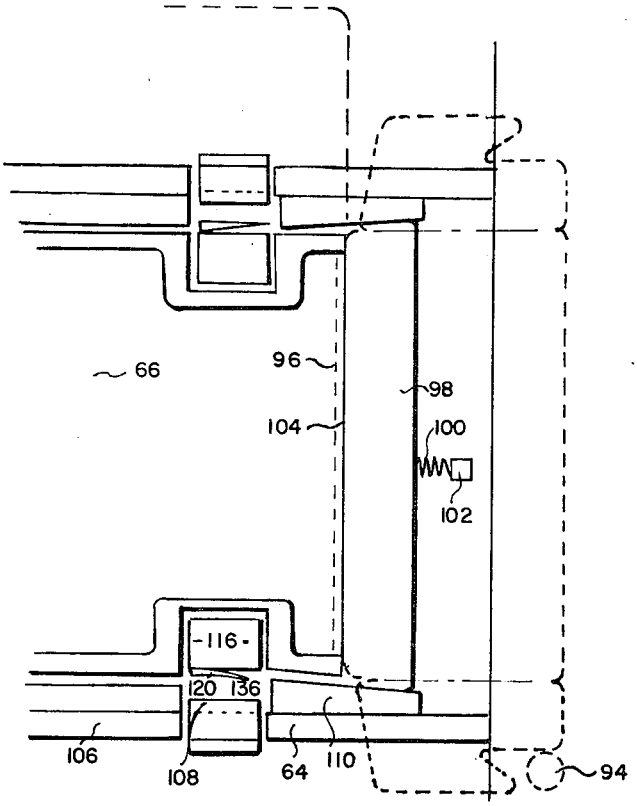
FIG. 3 of the drawing is a top partial plan view of the die and cooperating plunger of the carton erector with an end section of the carton of FIG. 1 shown positioned on the die in dotted lines.

The carton of FIG. 1 is of the well-known tab-slot interlocking type used in many different industries, for example to enclose bakery goods. The central area 2 of the carton 100 which is defined by fold lines 4, 6, 8 and 10, becomes the bottom of the erected carton. Opposed side panels 12 and 14, and opposed end panels 16 and 18 are shown hinged to the central panel 2 at the above-mentioned fold line. For purposes of forming a generally rectangular carton, the side panels are shown longer than the end panels, but of course the reverse may be or all panels could be of the identical length. Each end panel has an end flap attached to each of its side edges. For example, end 16 has flaps 20 and 22 attached to it by means of edges 24 and 26, which then become fold lines 24 and 26. The same is true for end 18 and its respective end flaps 28 and 30, which are attached thereto, respectively by fold lines 32 and 34.

The fold lines above mentioned may be of the cut and scored type as is conventional for allowing ease of folding along a given predetermined line. Additionally, fold lines 24 and 32 are either aligned with, or preferably paralleled and slightly offset outwardly with respect to the fold line 6 to compensate for the thickness of the sheet material in the folding operation, as is customary in the art. A similar sort of situation will exist as to fold lines 26 and 34 relative to fold line 10.

Each side panel of the carton 100 toward each end thereof has three connected slits 40, 42 and 44 which combine to form a slot 50. Each end flap includes a tab

52 to be inserted through the adjacent slot 50 to form a corner "lock" during carton erection. As will be more fully explained hereinafter, during carton erection tabs 52 are pushed inwardly through slots 50. Because the uppermost tips 54 of tabs 52 are higher than slits 44 in erected condition, once the tabs 52 are fully displaced through the slots 50, they engage the inside of the body of each side panel above the slots and are not easily dislodged back through the slots. The folding and locking process of this type of carton is well known to those skilled in the art.

Figure 4:
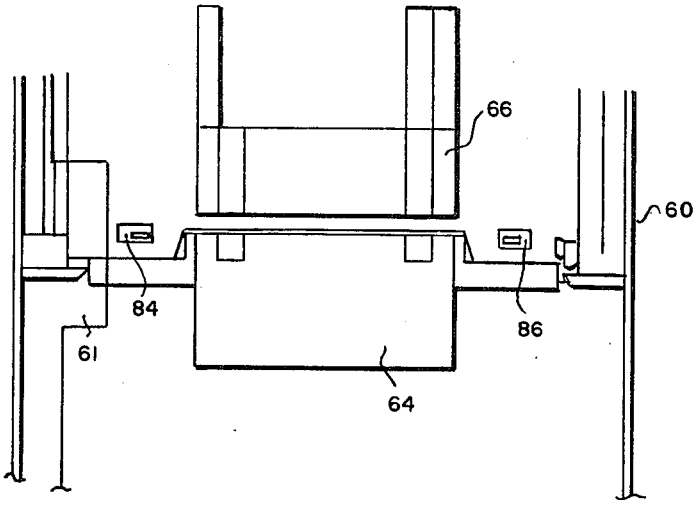
FIG. 4 of the drawing is a partial front view of the carton erector of FIG. 2.

Turning to FIGS. 2 and 4 of the drawing, there is seen erector 60 with associated blank hopper and feed mechanism 62.

With particular reference to FIG. 2 there is shown a vertical carton erector 60, carrying on its frame 61 a stationary female die 64 and movable plunger 66, said plunger being vertically reciprocable by means of attachment to movable shaft 68. The shaft and die are attached through means 63 and 65, not shown in detail, to the frame of the erector. Operatively positioned to the die and plunger is a blank carton hopper, generally indicated at 70. A stack of carton blanks 72 is placed in the hopper, on edge, selected in correct positionment to correspond to the die position when transferred thereto in the manner herein described. The uppermost parts of the cartons rest against carton stop 74 while the bottom edges rest on floor 76. Hopper pusher 80 rests on floor 76 and is springloaded to advance the stack of cartons.

The carton blanks are arranged in the carton hopper so that the undersides of the bottom panels (which will become the outside of the erected carton) face downwardly toward the die. A pair of feed arms 84 and 86 are shown in their rest position to either side of the die. Both feed arms are attached to shaft 88, which is rotatable by means not shown about a fixed longitudinal axis. Each feed arm carries two vacuum suction cups 90 and 92 which would be connected through appropriate tubing to a single vacuum pump. A vacuum release valve, to reduce or completely remove vacuum, also not shown, would be positioned in the tubing in known manner.

As is best illustrated by FIG. 4, the top surfaces of the feed arms are in planar alignment with the top surface of the forming head or die when the feed arms are in rest position. Thus, upon vacuum release, or preferably only reduced vacuum, the carton blank is in position for erection by the cooperating forming head and plunger. As soon as the carton has been erected and the plunger has passed upwardly back through the forming head to its uppermost position, or at least high enough so that it does not interfere with a descending carton blank, the feed arms are pivoted in unison about their common shaft until their vacuum cups engage the bottom-most carton blank in the hopper. The vacuum release valve has been closed and upon reversal of the rotation of the shaft, the feed arms directly pull a carton blank down onto the forming head. In the embodiment shown in FIG. 2 the feed arms are shown reciprocal through about a 70 degree angle of rotation.

Figure 6:
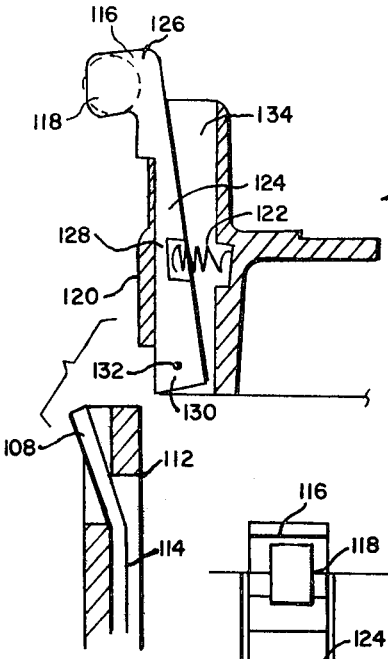
FIG. 6 of the drawing is an end sectional view of the erector of FIG. 2 taken along line 6—6 of FIG. 3.
Figure 5:
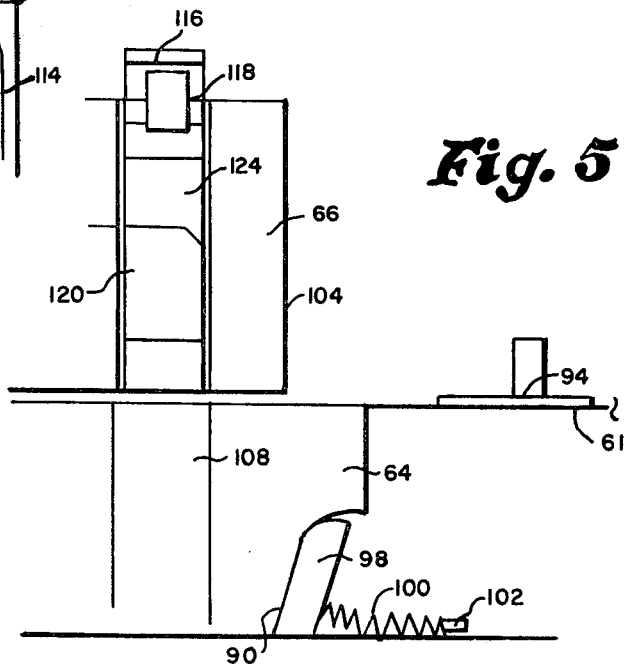
FIG. 5 of the drawing is a partial side view of the erector of FIG. 2.

FIGS. 3 and 6 depict in detail the plunger and die including the elements thereof which cooperate to erect and interlock the side and end panels of the carton. Carton guides may be employed projecting upwardly at each corner of the die to assist in correct alignment of the blank on the die by the feed arms. One such guide is shown at the lower right hand corner of FIG. 3 as vertical post 94.

One of the engineering advantages and marked improvements resulting from the instant invention, particularly the feed arm arrangement, is that guides such as stop 94, as well as other guiding arrangements such as slots along the top of the die to align the outer edges of the side and end panels, are unnecessary. The direct, pivotal movement of the feed arms, not involving turning the blank over or complicated multi-joint connections, repeatedly places the carton blank directly on the forming head in correct registration in precisely the identical position time after time. The supply hopper presents the carton to the feed arms in correct registration for direct placement onto the die without additional registration or alignment on the die. With prior art machines, frictional contact between carton and guides has been known to be sufficient to damage peripheral blank portions and/or to prevent free movement of the blank through the erection process, problems which can be avoided with the feed arm arrangement disclosed herein.

FIG. 3 of the drawing depicts one side of the die and plunger, top view, it being understood that the other side of the shown apparatus, to the left of the figure, would be a mirror image thereof. FIG. 6 is a sectional side view of cooperating die and plunger elements which lock the tab of the end panel into the corresponding side panel slot.

With particular reference to FIG. 3, the end panels of the carton blank are erected in known manner through the use of an abutment surface, generally indicated at 96, along the end portion of the die. Surface 96 may cooperate with or be part of folding bar 98 pivotally mounted at its base. In rest position folding bar 98 lies on its side due to tension exerted by spring 101, the other terminus of which is connected to mount 102. An edge of bottom 104 of plunger 66 is registered to press down on the inside surface of the fold bar by fractionally overlapping it, causing the fold bar to press the end panel into full upright condition against the side of the plunger as the plunger passes through the die.

Each side of the die consists of a single secondary guide 106 positioned between two camming surfaces 108. Primary guides 110 are angled outwardly from each camming surface toward the respective ends of the die to a point at least beyond the end of the plunger, preferably completely overlapping each fold bar 98.

Turning to FIG. 6, each camming surface 108 consists of an upper inwardly inclined camming surface 112 which leads to a vertical surface 114. With reference to the plunger, there is shown a knife holder 116 sitting in cavity 134. The knife holder consists of a frame portion 123 having a head section 126, a middle section 128 and a base section 130. There is a freely rotatable roller 118 journaled into the head 126 and a projecting knife 120 carried by the middle section 128. Frame 124 can be pivoted inwardly from its base 130 around shaft 132. Spring 122 is of the compressible type which allows the knife holder to be pivotally forced into cavity 134 by external pressure. The spring returns the knife holder to the position shown in FIG. 6 upon the removal of each pressure.

The erection and interlocking of a side and an end panel of a carton blank of the type depicted in FIG. 1 by the plunger and die arrangement of FIGS. 3 and 6 will now be described. The upper surface of the secondary guide, which is slightly raised as compared with the upper surface of the primary guide, which in turn is higher than end panel abutment surface 96, initiates folding of the side panel about its fold line. Approximately simultaneously therewith, but fractionally later, folding of the end panel about its fold line is initiated by abutment surface 96. As the side panel is erected, the primary guide, the inside portion adjacent the camming surface being closer to the plunger than the secondary guide (that is, is offset inwardly as compared to the secondary guide) pushes the section of the side panel between the camming surface and the end of the plunger inwardly. As seen best by FIG. 3, the portion of the side panel between the slot and panel edge is the panel area displaced inwardly by the primary guide, thereby opening the insertion slot. It should be noted that the center portion of the side panel is not displaced. Because the primary guide extends beyond the end of the plunger, it initiates folding of the end flap of the end panel about its fold line. As this occurs the angled surface of the primary guide guides the end flap along the outside of the side panel toward the slot. As is shown most clearly in FIG. 3, edge 136 of the knife 120 juts outwardly slightly more than the innermost portion of the primary guide. Through predetermined registration, as the fold bar completes the erection of the end panel, the tab of the end flap is guided by the primary guide to a position just to the inside of the knife edge, which by this time is jutting slightly out of the side panel slot. By this time in the carton erection process, the plunger has been lowered to a point where the knife holder roller is gliding along inclined surface 112. As the roller reaches vertical surface 114, frame 124 pivots into cavity 134, carrying with it the knife edge which, in turn, pushes the end flap tab through the side panel slot into interlocking engagement therewith.

The carton supply hopper used with the vertical carton erector will now be described in detail in conjunction with the remaining Figures of the drawing.

An essential feature of the supply hopper is to provide a constantly reducing force to the carton stack as the carton stack is used. By the use of smooth surfaces and proper geometry between the floor of the hopper, the vertical plane of the carton stack and horizontal, the force of friction of the carton stack on the carton support or floor of the hopper is reduced to as low a value as possible. In addition, the geometrical relationships are such that the force of friction is substantially only dependent upon carton weight (assumed to be the same for each carton in a stack) and number of cartons in the stack. Once this is done, it is possible to utilize a constantly reducing force to push the cartons along to maintain substantially the same force or pressure on the leading carton regardless of the number of cartons in the stack, in accordance with the following theoretical formulae:

$$F_{hp} = F_f = F_x$$

where $F_{hp}$ = Force required by hopper pusher $F_f$ = Force of friction of the carton stack on the carton support $F_x$ = Force required to maintain proper preload against hopper stops (constant)

$F_f$ = Weight of each carton × number of cartons × coefficient of friction.

The geometry of the hopper assures that $F_f$ is a substantially pure value obtained by the equation and that no other significant factors affecting $F_f$ are present. Then $F_{hp}$ = weight of each carton × number of cartons × coefficient of friction + $F_x$, or $F_{hp}$ is directly proportional to the number of cartons, which is the same as the stack length. Then it only becomes necessary to utilize a pushing force mechanism directly proportional to the stack length, such as a spring extending from the front of the hopper to a pusher positioned against the last carton of the stack. As the stack length is reduced, $F_f$ is reduced and the spring force (which is now equal to $F_{hp}$) is reduced correspondingly. Of course, more complicated means to exert a force proportional to the length of the carton stack may be employed.

FIG. 7 of the drawing is a side view of the carton hopper. To place the hopper in proper perspective with relationship to horizontal and vertical axis when in operating position, line 200 is horizontal to the earth's surface and 202 is 90° thereto, or a vertical axis. Carton support or floor 76 is provided with a highly polished surface, such as a polished chrome surface, to reduce friction as much as possible. The carton support is arranged at a low angle, about 10° to 20°, preferably about 15°, lower than horizontal. The cartons are stacked in the hopper at an acute angle to the carton support, which angle is small with respect to the vertical axis. This carton angle is about 80° to 87°, preferably about 85° to the carton support.

In FIG. 7, carton pusher 80 is positioned at substantially the same angle as the stack of cartons. The carton plane is indicated by leading carton 204. The hopper pusher includes pushing plate 210, handle 212 and as shown in FIG. 8, brace 206 engaged by spring 208.

Returning to the hopper magazine, a side guide 211 is positioned about two thirds of the way up the side of the hopper on each side thereof, and runs the length of the magazine to guide the carton blanks toward correct positionment at the front end of the hopper.

As shown in the front view of the hopper, FIG. 9, a plurality of side and bottom carton stops 214, which with carton stop 74, are arranged in the carton plane and are adjusted to intrude into the path of the carton blanks only far enough to prevent the blanks from passing through the front end of the hopper prior to engagement by the feed arms. The front edges of the side guides 212 may be designed to also function as carton stops.

As is apparent, all surfaces of the type in contact with the cartons should be very smooth to minimize friction. To this end, the carton support and side guides may be formed of smooth, polished surfaces. The angle of the support is set at about the angle of repose of the carton (that is, the carton nearly slides down the support under its own weight), but may be greater or less depending upon the coefficient of friction of the surface of the support. The side guide provides left and right registration to the carton stock. These guides with the carton stops and angle of incline of the support, orient the carton blank for proper registration on the die.

The hopper pusher plate is mounted on linear bearings and is operable angularly (swings sideways) for easy loading of the hopper. The plate-bearing assembly is pulled toward the front of the hopper by a spring 208.

In the operation of the hopper, the following sequence can be carried out:

1. The hopper pushers are pulled to the rear of the hopper and twisted to clear the hopper for loading.
2. Cartons are placed into the hopper. Cartons rest upon the carton supports, and the carton side guides are adjusted against the sides of the cartons. The carton top stop is adjusted downward against the top of the carton stack.
3. The hopper pushers are twisted and released against the rear of the carton stack. The spring's force is applied to the carton stack and, consequently, to the front carton. (The resultant force on the front carton is approximately the same regardless of the stack length.)
4. Operation of the carton feed means removes the front cartons, one at a time.
5. As each carton is removed, the carton stack is pushed down automatically by the spring force on the hopper pusher.

I claim:

1. In a carton erecting apparatus of the type wherein a stationary die, reciprocable plunger and carton blank feeding means are carried by a frame, said apparatus including a carton blank reservoir remote from said die and said plunger and comprising a carton hopper to releasably and sequentially present said carton blanks to said carton blank feeding means, said feeding means being capable of advancing to said hopper, engaging the presented carton blank and placing said blank on said die in carton erecting position, the improvement comprising said hopper having a straight inclined smooth carton blank support surface upon which a stack of flat carton blanks can rest on edge, the angle of inclination of said support surface relative to the horizontal being substantially equal to the angle of repose so that the carton blanks are on the verge of sliding down said inclined surface under their own weight, carton blank pusher means carried by said hopper to push said stack of cartons down said inclined support surface, spring means biasing said pusher means to maintain substantially equal pressure on the leading carton regardless of the length of the stack, said pusher means exerting a pressure against the stack directly porportional to the length of the stack, lateral guide means to guide said stack down said support surface and a plurality of carton stops positioned around the lower most end of said hopper to prevent said carton blanks from being pushed out of said hopper; said stops being located in a plane parallel to the plane of said pusher means with both of said planes being located at an angle relative to the support surface intermediate a vertical plane and a plane perpendicular to said support surface.

2. The apparatus as set forth in claim 1 wherein said angle of inclination is 10° to 20° below horizontal.

3. The apparatus as set forth in claim 2 wherein said angle of inclination is about 15°.

4. The apparatus as set forth in claim 1 wherein the angle between the plane of said carton stops and said carton support surface is between 80° and 87°.

5. The apparatus as set forth in claim 4 wherein said angle is about 85°.

* * * * *